US012275578B1

(12) United States Patent
Davet

(10) Patent No.: US 12,275,578 B1
(45) Date of Patent: Apr. 15, 2025

(54) PRODUCT PACKAGING FOR WASHERS AND METHOD OF USE

(71) Applicant: Solon Manufacturing Company, Chardon, OH (US)

(72) Inventor: George Davet, Chardon, OH (US)

(73) Assignee: SOLON MANUFACTURING COMPANY, Chardon, OH (US)

( * ) Notice: Subject to any disclaimer, the term of this patent is extended or adjusted under 35 U.S.C. 154(b) by 0 days.

(21) Appl. No.: 18/392,886

(22) Filed: Dec. 21, 2023

(51) Int. Cl.
*B65D 85/58* (2006.01)

(52) U.S. Cl.
CPC ..... *B65D 85/58* (2013.01)

(58) Field of Classification Search
CPC ..... B65D 85/02; B65D 85/58
USPC ..... 206/303
See application file for complete search history.

(56) References Cited

U.S. PATENT DOCUMENTS

| | | | | |
|---|---|---|---|---|
| 1,727,235 | A | 2/1927 | Joyse | |
| 1,780,268 | A | 5/1928 | Miller | |
| 2,257,891 | A | 2/1940 | Stokes | |
| 3,231,074 | A | 1/1966 | Block | |
| 3,306,462 | A | 2/1967 | DaCruz | |
| 3,316,924 | A | 5/1967 | Ware | |
| 3,606,008 | A | 9/1971 | Lusetti | |
| 3,850,296 | A | 11/1974 | Hirata et al. | |
| 4,588,086 | A | 5/1986 | Coe | |
| 4,796,756 | A | 1/1989 | Ott | |
| 5,163,580 | A * | 11/1992 | Beach | B65B 15/00 221/312 A |
| 5,394,986 | A | 3/1995 | Oya et al. | |
| 5,441,152 | A | 8/1995 | Estes | |
| 5,445,263 | A * | 8/1995 | Mohlenkamp | B65D 1/36 206/445 |
| 5,810,163 | A | 9/1998 | Nakabayashi | |
| 6,237,767 | B1 * | 5/2001 | Lee | B25H 3/023 206/234 |
| 7,367,454 | B1 | 5/2008 | Back et al. | |
| D657,427 | S | 4/2012 | Gelinotte et al. | |
| D964,862 | S | 9/2022 | Evans et al. | |
| 2004/0035726 | A1 * | 2/2004 | O'Toole | B65D 85/02 206/303 |

(Continued)

FOREIGN PATENT DOCUMENTS

| | | |
|---|---|---|
| CH | 713291 B1 | 8/2020 |
| WO | PCT/US96/17105 | 4/1998 |

OTHER PUBLICATIONS

Shadowfoam Simply Cut and Peel, https://www.shadowfoam.com/, retrieved from the Internet Nov. 8, 2023.

(Continued)

*Primary Examiner* — Jacob K Ackun
(74) *Attorney, Agent, or Firm* — Dominic A. Frisina

(57) ABSTRACT

Packaging for washer hardware products is provided along with a method of use. The packaging includes a semi-closed box having a pair of lateral walls with retainer beads near their upper ends. The packaging also includes a pair of end walls, one of which includes an opening for accessing the central hole of a column of washers contained therein. The column can be removed by inserting a rod through the central holes of the washers and lifting the rod upward while holding the packaging down, thereby forcing the washers between the retainer beads and through the open top of the box.

18 Claims, 12 Drawing Sheets

(56) References Cited

U.S. PATENT DOCUMENTS

| | | | | |
|---|---|---|---|---|
| 2007/0144924 | A1* | 6/2007 | Yamashita | B65D 71/70 206/338 |
| 2008/0120945 | A1* | 5/2008 | Holbrook | B65D 75/42 53/396 |
| 2013/0292901 | A1 | 11/2013 | Kneitel | |
| 2016/0007772 | A1* | 1/2016 | Schoeler | A47F 7/02 206/775 |
| 2019/0236888 | A1 | 8/2019 | Klinger et al. | |
| 2022/0355968 | A1 | 11/2022 | Lee et al. | |

OTHER PUBLICATIONS

Harbor Freight Pittsburgh 1/4 in., 3/8 in., 1/2 in. Drive SAE and Metric Socket Set, 64-Piece, https://www.harborfreight.com/14-in-38-in-12-in-drive-sae-and-metric-socket-set-64-piece-63461.html, retrieved from the Internet Nov. 8, 2023.

* cited by examiner

PRODUCT PACKAGING FOR WASHERS AND METHOD OF USE

I. BACKGROUND OF THE INVENTION

A. Field of Invention

The invention generally relates to the field of packaging for fasteners, namely, washers.

B. Description of the Related Art

It is well known to package washer fasteners for retail point of sale display. Generally, such packaging includes blister packs, clamshell packs, cardboard boxes, screw-cap jars, and heat-sealed or resealable plastic bags. In each instance, the product pieces within the packaging are generally not arranged in a fixed orientation relative to each other. Rather, they are free to move within the container. Prior art packaging generally relies on lids or other package closures to retain the pieces within the packaging. The washers may be removed one at a time or may be dumped from the packaging all at once. Such arrangements to not permit withdrawal of all the washers at once in a single stacked column.

The prior art does not teach or suggest using a boss, bead or other protuberance to retain washers within a recessed space or tray. The prior art also does not teach or suggest packaging, such as a tray, for containing the washers and organizing them in a stacked column configuration. Lacking features for holding washers in a column and retaining them within the packaging, the prior art also cannot teach or suggest a means for withdrawing all the washers at once from such packaging in a single column.

Some embodiments of the present invention may provide one or more benefits or advantages over the prior art.

II. SUMMARY OF THE INVENTION

Some embodiments include a washer carrier, comprising: a semi-closed box having: an elongate rectangular base wall defining a length and a width; a first lateral wall contiguous with and extending away from the base wall, the first lateral wall having an inward facing surface; a first retainer bead extending along an entire length of the first lateral wall, and disposed on the inward facing surface of the first lateral wall between the first lateral edge and the base wall; a second lateral wall contiguous with and extending away from the base wall, the second lateral wall having an inward facing surface; and a first partial end wall having a first segment contiguous with the first lateral wall and the base wall, and a second segment contiguous with the second lateral wall and the base wall, wherein the first segment and the second segment are separated by a first gap.

Some embodiments include a method of withdrawing a column of washers from a washer carrier, comprising the steps of: positioning a rod proximal to a first partial end wall of a washer carrier; inserting the rod through each central hole of each washer of a column of washers; holding the washer carrier stationary while applying upward force to the rod; the rod impinging upon a first retainer bead of the washer carrier, wherein the applied force is sufficient to flex a first lateral wall and a second lateral wall apart allowing the column of washers to pass therebetween; and withdrawing the column of washers from the washer carrier.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof, wherein like reference numerals indicate like structure, and wherein:

FIG. 1B-2 is a bottom view of an embodiment having a solid rectangular register;

FIG. 1B-3 is a bottom view of an embodiment having a rectangular perimeter wall register;

FIG. 1B-4 is a bottom view of an embodiment having four register walls;

FIG. 1B-5 is a bottom view of an embodiment having four corner register walls;

FIG. 2 is a top view of an embodiment containing a column of washers;

FIG. 3 is a top view of two instances of an embodiment arranged side-by-side;

FIG. 4 is a perspective view of a two instances of an embodiment arranged in a vertical stack;

FIG. 5 is an illustration of a method of withdrawing washers from an embodiment.

IV. DETAILED DESCRIPTION OF THE INVENTION

As used herein the terms "embodiment", "embodiments", "some embodiments", "other embodiments" and so on are not exclusive of one another. Except where there is an explicit statement to the contrary, all descriptions of the features and elements of the various embodiments disclosed herein may be combined in all operable combinations thereof.

Language used herein to describe process steps may include words such as "then" which suggest an order of operations; however, one skilled in the art will appreciate that the use of such terms is often a matter of convenience and does not necessarily limit the process being described to a particular order of steps.

Conjunctions and combinations of conjunctions (e.g. "and/or") are used herein when reciting elements and characteristics of embodiments; however, unless specifically stated to the contrary or required by context, "and", "or" and "and/or" are interchangeable and do not necessarily require every element of a list or only one element of a list to the exclusion of others.

Terms of degree, terms of approximation, and/or subjective terms may be used herein to describe certain features or elements of the invention. In each case sufficient disclosure is provided to inform the person having ordinary skill in the art in accordance with the written description requirement and the definiteness requirement of 35 U.S.C. 112.

Figure 1A:
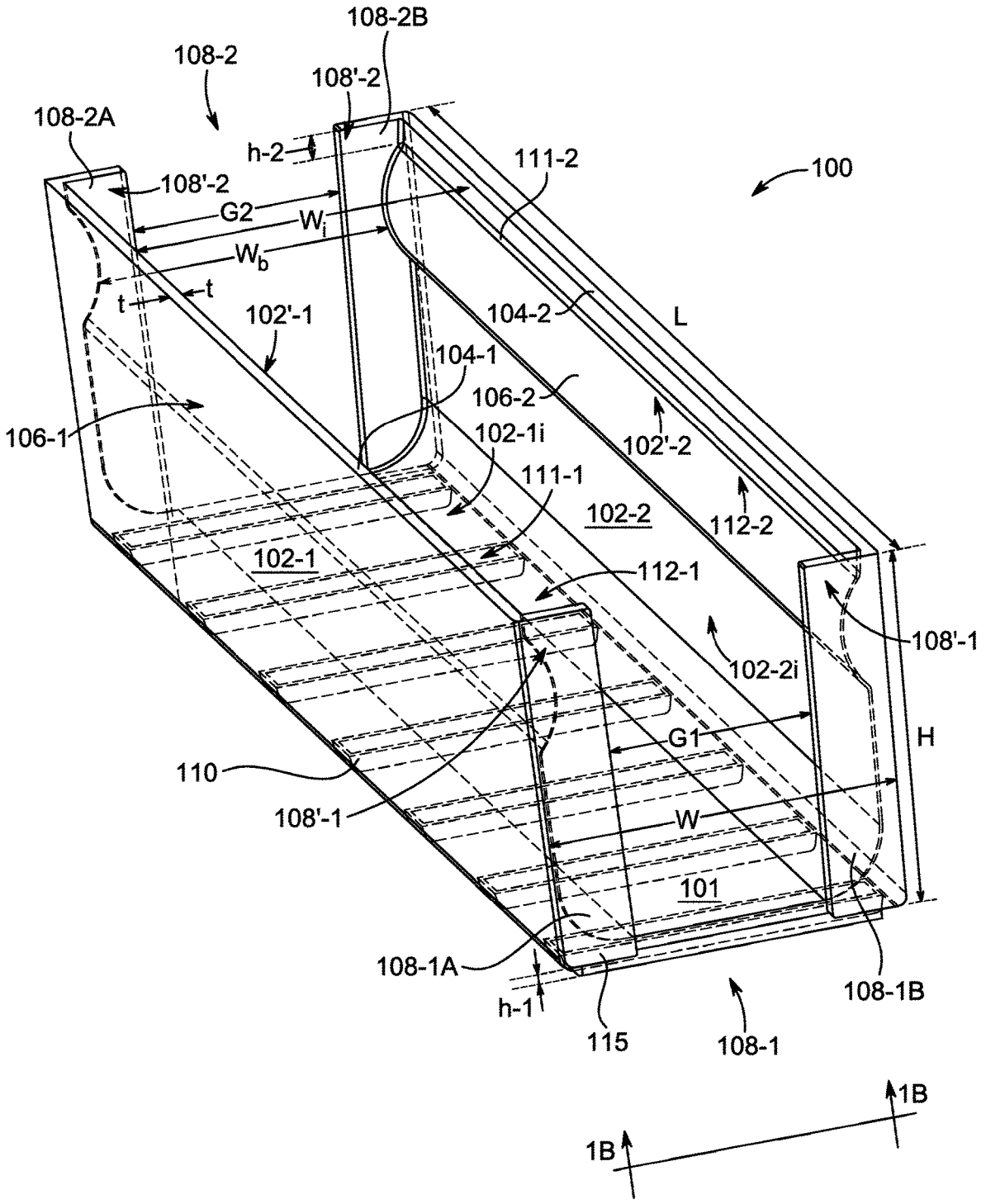
FIG. 1A is a semitransparent view of an embodiment.

Referring now to the drawings wherein the showings are for purposes of illustrating embodiments of the invention only and not for purposes of limiting the same, FIG. 1A is a semitransparent view of a washer carrier 100 embodiment of the invention. The embodiment comprises a semi-closed box 100. As used herein, the phrase semi-closed box means a box missing at least one wall or part of at least one wall so that the interior is not entirely enclosed. For instance, the embodiment shown in FIG. 1A has no top wall, and both end-walls are partial end walls (108-1 and 108-2), meaning part of the end walls is omitted, creating openings.

The embodiment of FIG. 1A has an elongate rectangular base wall 101 defining a length L and a width W as shown in FIG. 1A. The base wall 101 is contiguous with a first lateral wall 102-1 and a second lateral wall 102-2. The word contiguous is meant to include unitary parts, such as those cast from a common die or mold, and joined parts such as those joined with fasteners or welds or any other known means. The first and second lateral walls 102-1 and 102-2 extend away from the base wall 101 and terminate in first and second lateral edges 104-1 and 104-2. While the lateral walls and end walls of the embodiment 100 are shown perpendicular to the base wall 101 and to each other, this is not critical and is not a limitation of the invention. Walls extending at oblique angles to the base wall 101 are also contemplated as embodiments of the invention.

The first and second lateral walls 102-1 and 102-2 each have a height as shown in FIG. 1A, which is illustrated as an uppermost extent of the lateral walls, i.e. the first and second lateral edges 104-1 and 104-2. In the illustrated embodiment, the heights of the first and second lateral walls are equal; however, this is not necessary for all embodiments. For instance, in embodiments lacking features for stacking instances of the embodiment, one on top of the other, the heights of the first and second lateral walls may differ without affecting the functionality of the embodiment. However, in embodiment adapted for stacking, the first and second lateral walls, and/or the first and second end walls, are preferably sufficiently equal in height to permit consistent and stable stacking.

The stackability of an embodiment may be preserved, however, even where the first and second lateral walls 102-1 and 102-2 differ in height relative to the end walls. In other words, some embodiments may rely on either the lateral walls or the end walls, and not both, to support stacked instances of the embodiment. In such embodiments the height of the lateral walls can be unequal to that of the end walls without affecting the functionality of the embodiment. In still other embodiments, neither the end walls nor the lateral walls are used for stacking instances of an embodiment. For instance, the base wall may include structures for engaging the upper edges 111-1, 111-2 of a pair of retainer beads 106-1, 106-2 in a stacked configuration. In such embodiments the lateral walls and the end wall could all be unequal in height without affecting stackability.

The specific form of the first and second lateral edges 104-1 and 104-2 is not critical, and may deviate significantly from the drawing. For example, in some embodiments the function of the first and second lateral edges 104-1 and 104-2 is to provide a seat for a second instance of the embodiment stacked on top of the first instance. In other embodiments, upper edges 111-1, 111-2 may serve this purpose. Similarly, embodiments may have end walls with heights greater than the lateral walls, where the end wall edges provide a seat for the second instance of the embodiment. In either case the particular form of the first and second lateral edges 104-1 and 104-2 would be unimportant. The person having ordinary skill in the art will be readily capable of determining a suitable height or heights of the lateral walls and end walls, and likewise determining a suitable form, shape or contour of the lateral edges and the equivalent edges of the ends walls, as a matter of design choice and/or without undue experimentation.

Embodiments include at least a first retainer bead 106-1 on either lateral wall. For the sake of simplifying nomenclature, and without intending to limit the invention, the first retainer bead 106-1 said to be disposed on the first lateral wall 102-1. More specifically, the retainer bead is disposed on an inward facing surface of the lateral wall 102-1*i*. As used here, the inward facing surfaces of the lateral walls (102-1*i* and 102-2*i*) are those which face inward toward each other, and contact product contained between the lateral walls. The retainer bead 106-1, or retainer beads, where there is more than one, extend along substantially the entire length of the inward facing surface of a lateral wall. In this context "substantially" is meant to indicate that a retainer bead may extend less than the entire length of a lateral wall's inward facing surface, but only to the extent that any difference is too small to permit washers contained within the carrier to pass through a gap resulting from the difference in length.

Figure 1B:
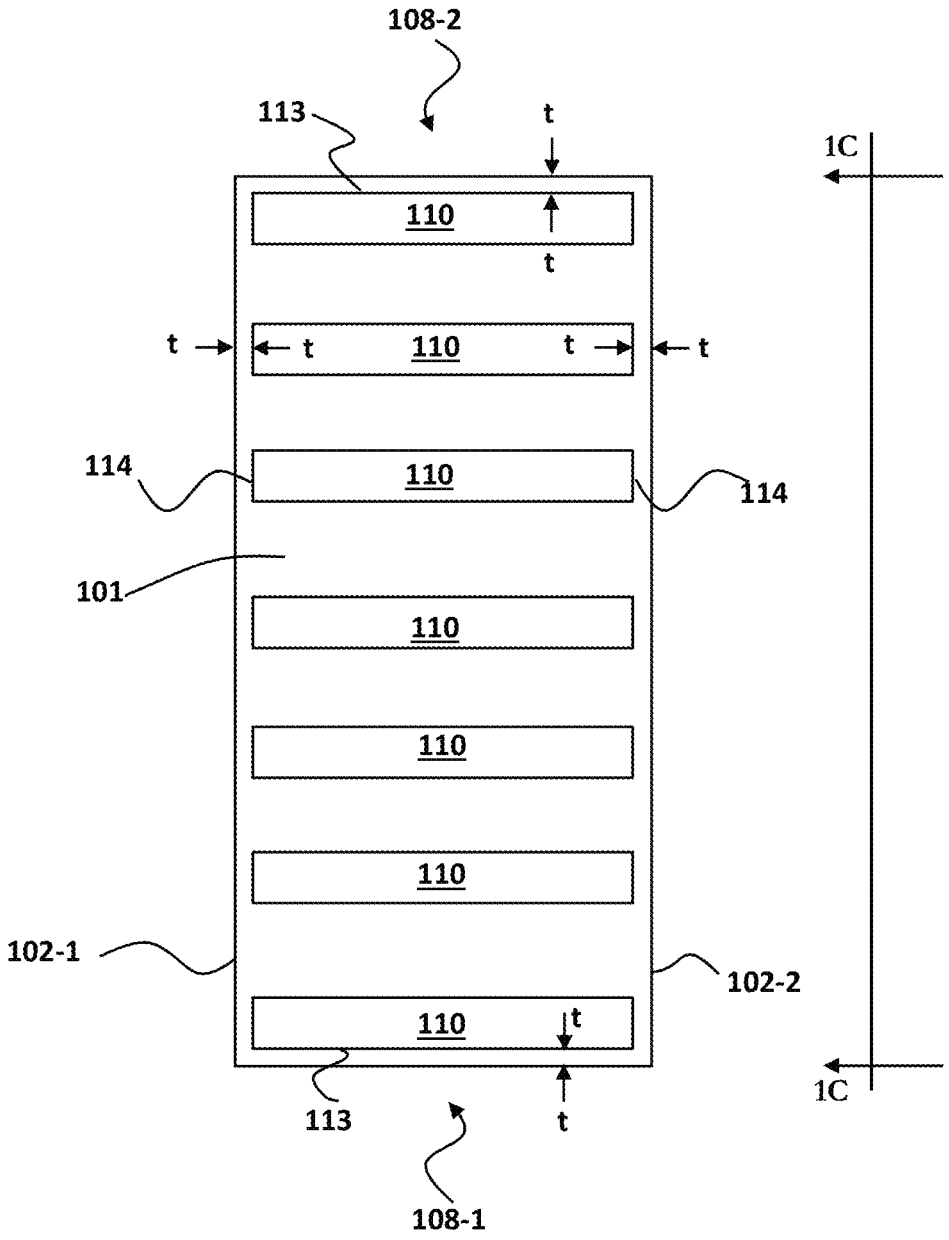
FIG. 1B is a bottom view of the embodiment of FIG. 1A taken along line 1B-1B.

Embodiments also include end walls to further contain washers within the carrier 100. An end wall may be partial or complete. As used here, a partial end wall has an opening dimensioned to expose the central hole of a washer column, of a predetermined type of washer, contained therein. In other words, the embodiment overall, including this opening, is dimensioned to accommodate a selected model of washer. Different washer models may require differently dimensioned embodiments to accommodate them and function according to embodiments of the invention. As shown in the embodiment illustrated in FIG. 1A the opening in the end walls is a gap denoted G-1 or G-2. FIG. 4 shows that the gaps are dimensioned to expose substantially the entire central hole 200*h* of the washer column 202. As used here, substantially is meant to indicate that the degree of exposure is sufficient for the intended function as described in relation to FIG. 5. The gap also has no structural upper edge, so a rod can pass upward through the gap and out of the carrier (see e.g. FIG. 5 panels 3 and 4). In contrast to a partial end wall, a complete end wall has no gap. Embodiments may have no more than one complete end wall.

With continuing regard to FIG. 1A, the illustrated embodiment has two partial end walls, 108-1 and 108-2, and no complete end wall. The first partial end wall 108-1 has two segments, 108-1A and 108-1B, both of which are contiguous with the base wall 101 and either the first or second lateral wall (102-1 or 102-2). The segments are separated by a first gap G-1. Similarly, the second partial end wall 108-2 as two segments, 108-2A and 108-2B, both of which are contiguous with the base wall 101 and either the first or second lateral wall (102-1 or 102-2). The segments are separated by a second gap G-2. The illustrated embodiment includes a pair of retainer beads 106-1, 106-2 disposed on the inward facing surfaces 102-1*i*, 102-2*i* of both lateral walls 102-1, 102-2. The beads face each other and are disposed in equivalent positions on the inward facing surfaces 102-1*i*, 102-2*i* between the base wall 101 and the lateral edges 104-1, 104-2. The minimum straight-line distance $W_b$ between the first and second retainer beads 106-1, 106-2 is measured from apex to apex as shown in FIG. 1A. This distance $W_b$ is between 80% and 95% of a straight-line distance between the lateral walls 102-1, 102-2 denoted as $W_i$ in FIG. 1A.

The retainer beads 106-1, 106-2 retain a washer column 202 within a carrier embodiment by providing a force opposing withdrawal of the column 202. In order to withdraw a column of washers 202, the column must apply an upward force on the bottom edge of the retainer beads, causing the lateral walls 120-1, 120-2 to flex outward allowing the beads 106-1, 102 to separate sufficiently for the column 202 to pass therebetween. The degree of opposing force provided by the retainer beads depends in part on the ratio of $W_b$ to $W_i$, which corresponds to the degree to which the lateral walls must flex to allow the column to pass. The degree of opposing force also depends on properties of the material(s) chosen to construct the embodiment, especially Young's Modulus and the thickness of the chosen material. For example, an embodiment constructed entirely from steel would provide a higher degree of opposing force than the exact same embodiment constructed from a phenolic resin or a polyolefinic resin. Additionally, the degree of opposing force can be increased by bracing the lateral walls. For example, by joining the lower edges 115 of the end walls to the base wall 101 flexing the side walls 102-1, 102-2 outward applies an additional tensile force to the end walls, thereby increasing the amount of force required to separate the retainer beads 106-1, 106-2. Conversely, allowing the lower edges 115 of the end walls to float in relation to the base wall 101 would eliminate this added resistance.

In some embodiments, the degree of opposing force may also be adjusted constructing the retainer beads 106-1, 106-2 from a material having a desired compressibility. A more pliable retainer bead would tend to decrease the opposing force, while a less pliable retainer bead would tend to increase opposing force. Alternatively, the retainer beads may be spring-loaded. Thus, rather than allowing the bead to yield, the bead could compress a spring, or the bead itself may comprise a leaf spring. The person having ordinary skill in the art will be readily capable, without undue experimentation, of selecting the right combination of material choice, material thickness, and bracing to achieve a desired degree of force opposing withdrawal of a washer column.

Figure 6:
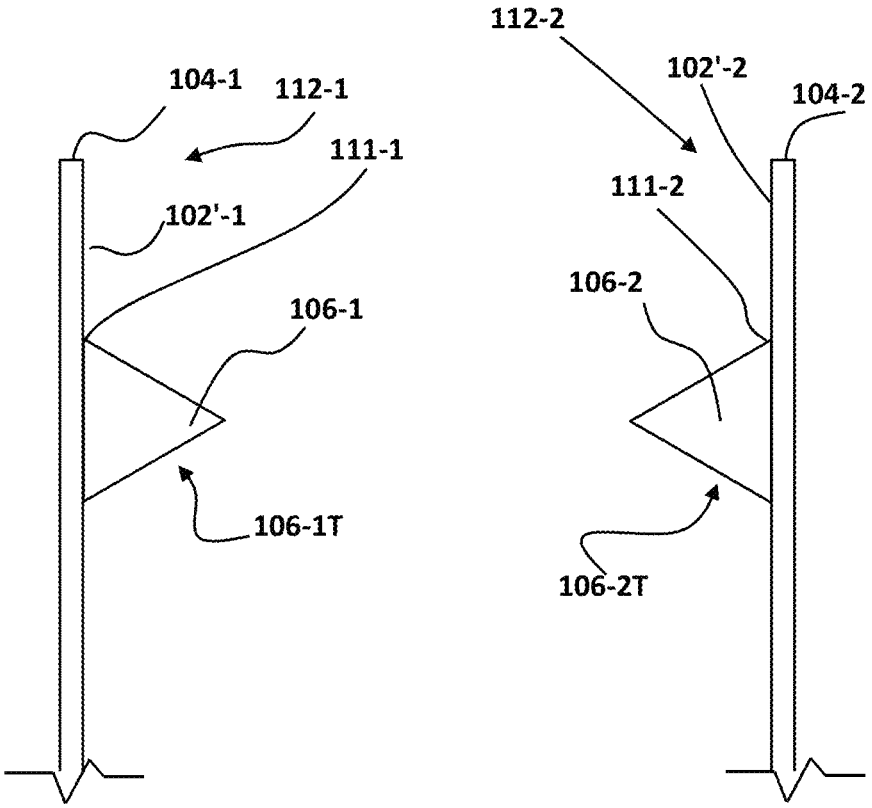
FIG. 6 is a cross sectional view of an embodiment having a pair for retainer beads with triangular cross sections.

Some embodiments may comprise a single retainer bead rather than a pair of opposing retainer beads. Such embodiments operate similarly to those with a pair of opposing beads, but the distance $W_i$, is measured from the apex of the single retainer bead to the opposing lateral wall. With continuing regard to variation on the retainer bead, the contour of a bead affects the resistance that it provides to withdrawal of a washer column. For example, an arcuate surface such as the hemicylindrical surface shown in FIG. 1A provides a similar opposing force regardless of whether the washer column is being withdrawn or loaded into an embodiment. Other embodiments may have retainer beads with triangular cross sections, such as that shown in the cross sectional view of FIG. 6.

Stackable embodiments of the invention include registration structures for fixing the orientation of stacked embodiments, and providing a stable stacking relationship. For example, FIG. 1B shows a plurality of registers 110 comprising slats joined the underside of the base wall 110. The slats have outward facing lateral faces 114 parallel to the first and second lateral walls 102-1, 102-2. The lateral faces 114 are inset a distance t from the outermost edge of the lateral walls. The distance t corresponds to the thickness of the lateral walls. Accordingly, the lateral faces 114 are adapted to engage the inside surface the lateral walls. The distance t can be slightly greater than the actual thickness of the lateral walls to provide a sufficiently loose fit for easy stacking and unstacking, as the person of ordinary skill will determine as a matter of design choice. Similarly, the slats 110 have outward widthwise faces 113 parallel to the first and second end walls 108-1, 108-2. The widthwise faces 113 are similarly inset by the distance t.

Figures 1, 1B, 2:
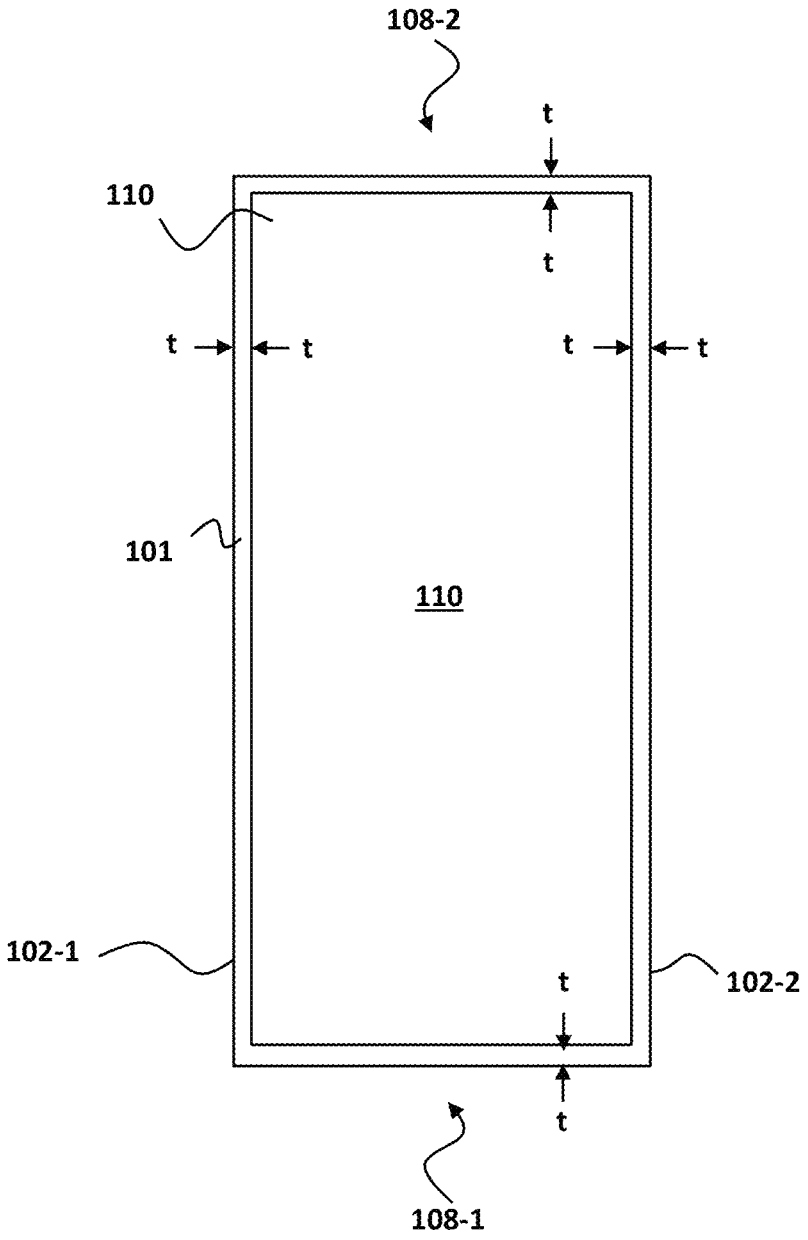
Figures 1, 1B, 2, 3:
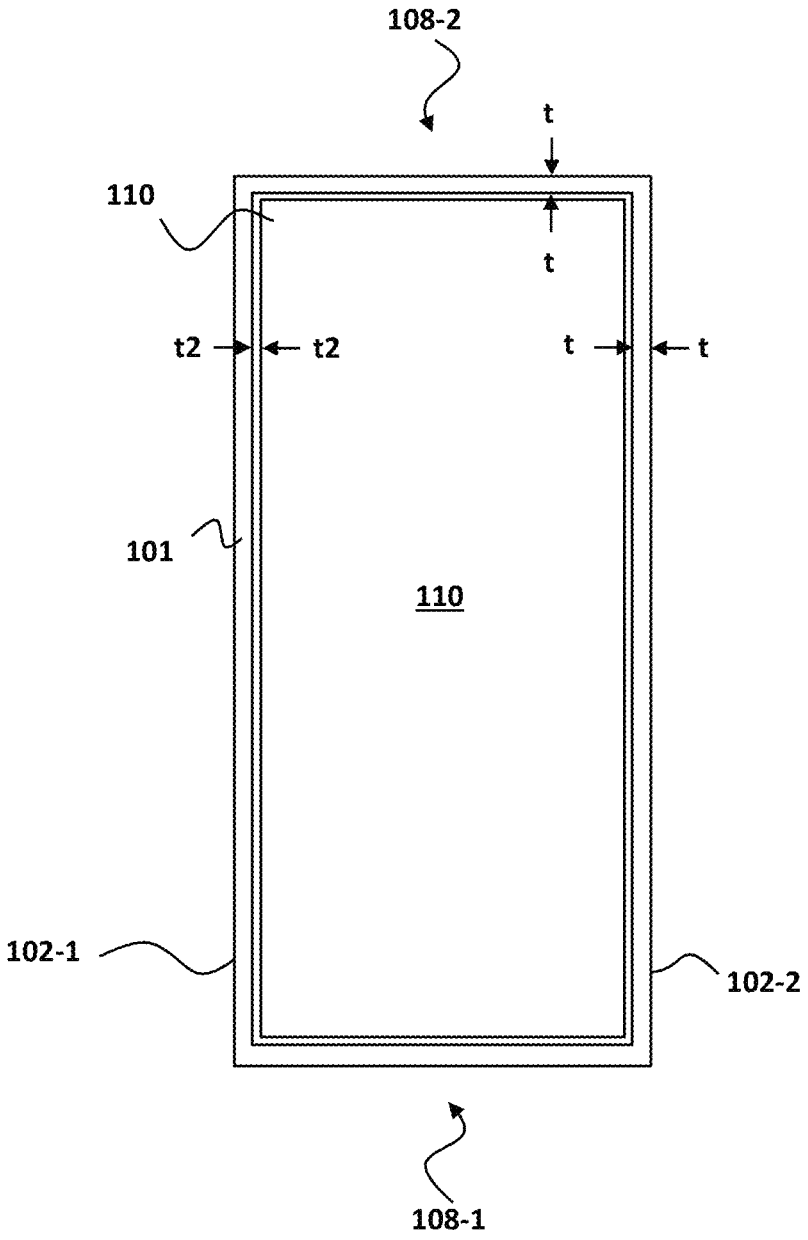
Figures 1, 1B, 2, 3, 4:
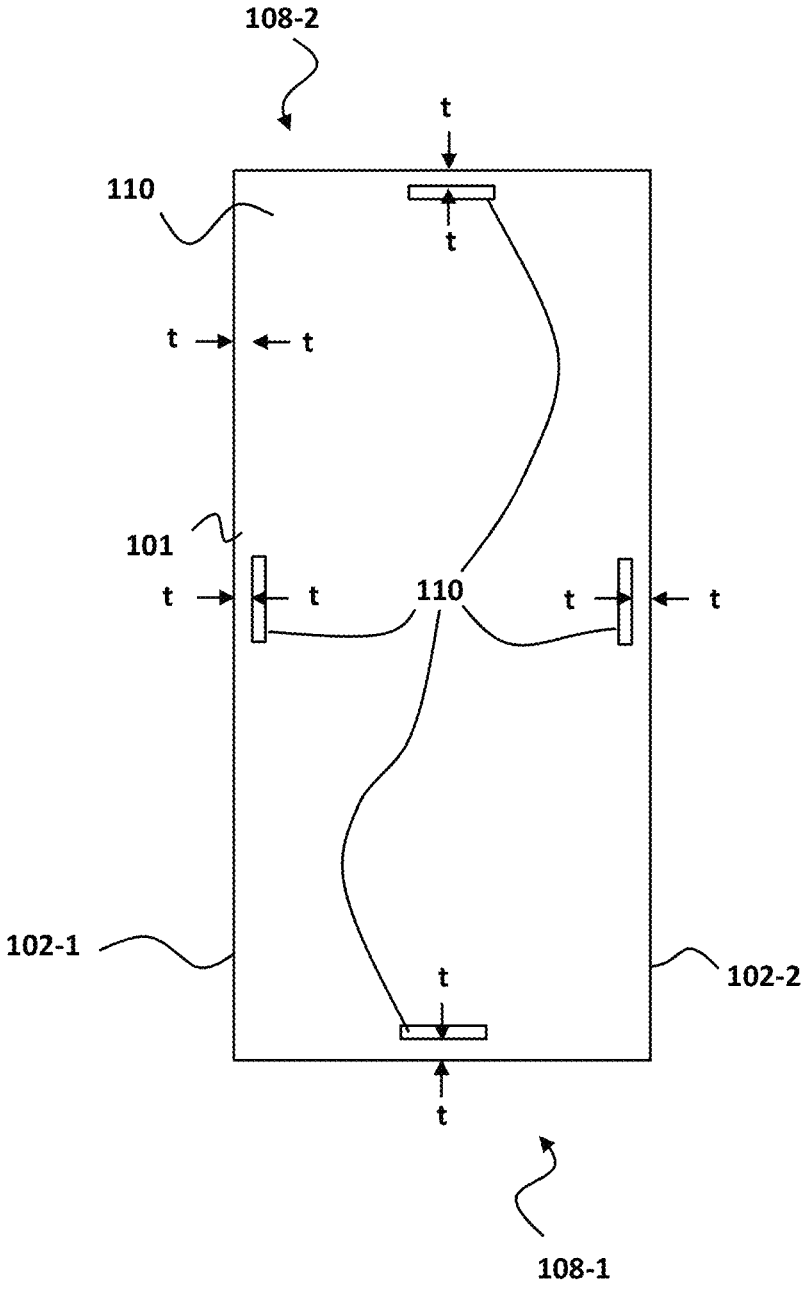

FIG. 1B-2 shows a variation of the register 110, where the register is a single rectangular piece rather than a plurality of slats. FIG. 1B-3 is another variation similar to that of FIG. 1B-2 but the register is a rectangular wall with a thickness t2. Another variation is shown in FIG. 1B-4 where the register 110 is a plurality of walls 110 providing minimal structure to fix the x-y position of one instance of an embodiment relative to another in a stack. Another embodiment having minimal structure is shown in FIG. 1B-5 where the register walls 110 are corner walls, one in each of the four corners of the rectangular base wall 101.

Figures 1, 1B, 2, 3, 4, 5:
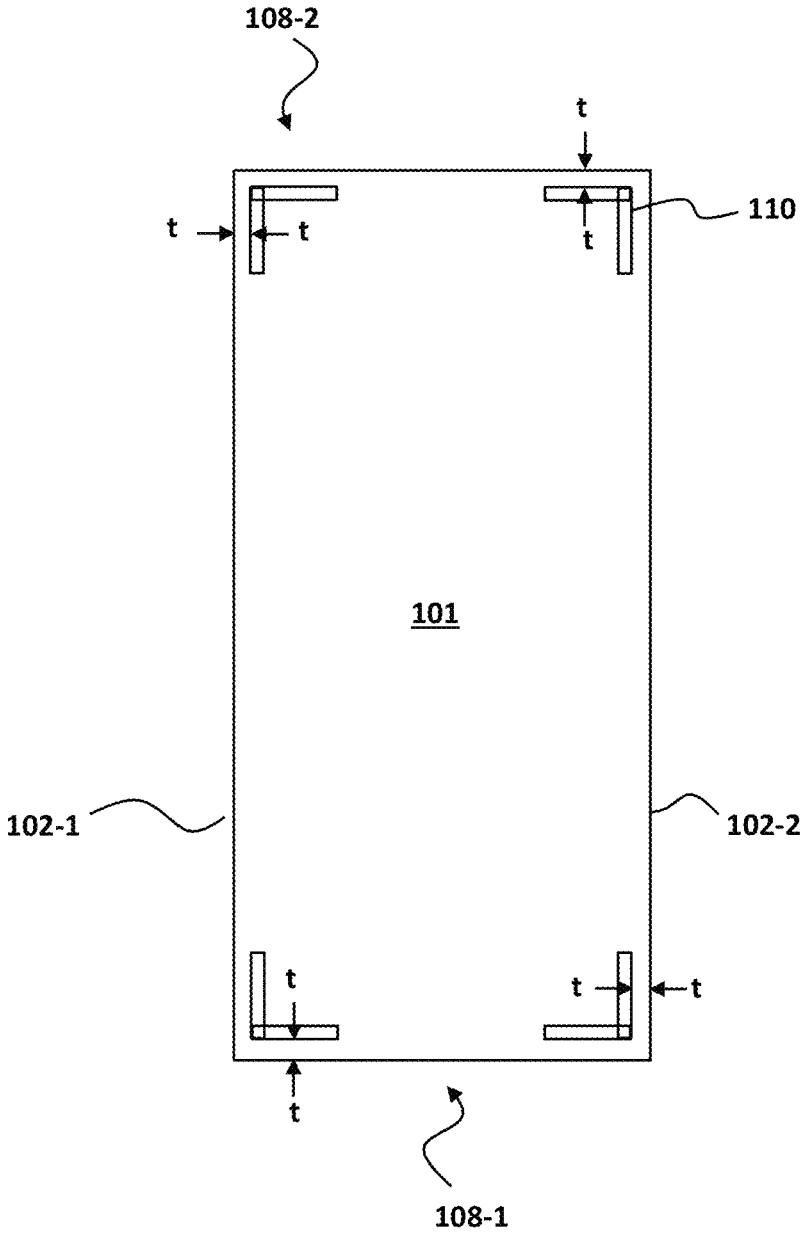
Figure 1C:
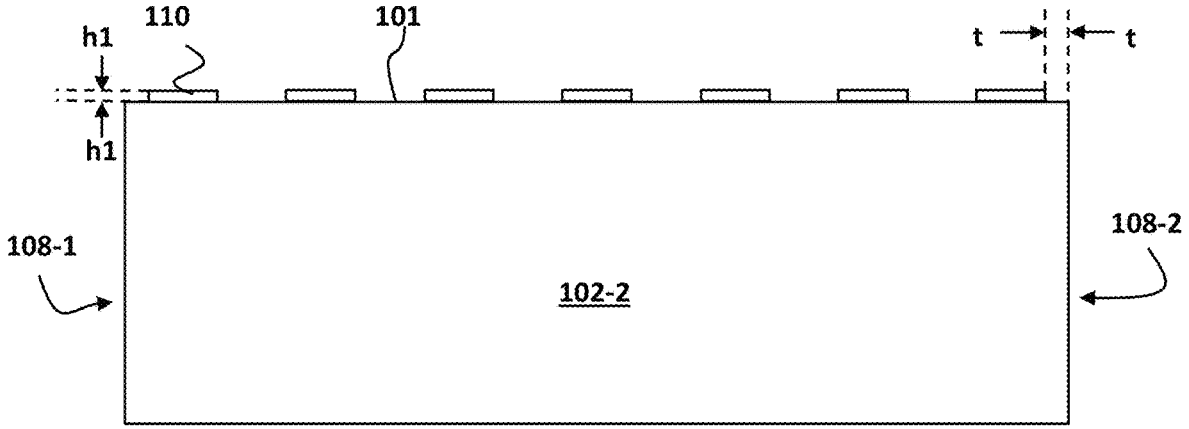
FIG. 1C is a side view of the embodiment of FIG. 1B taken along line 1C-1C.
Figure 2:
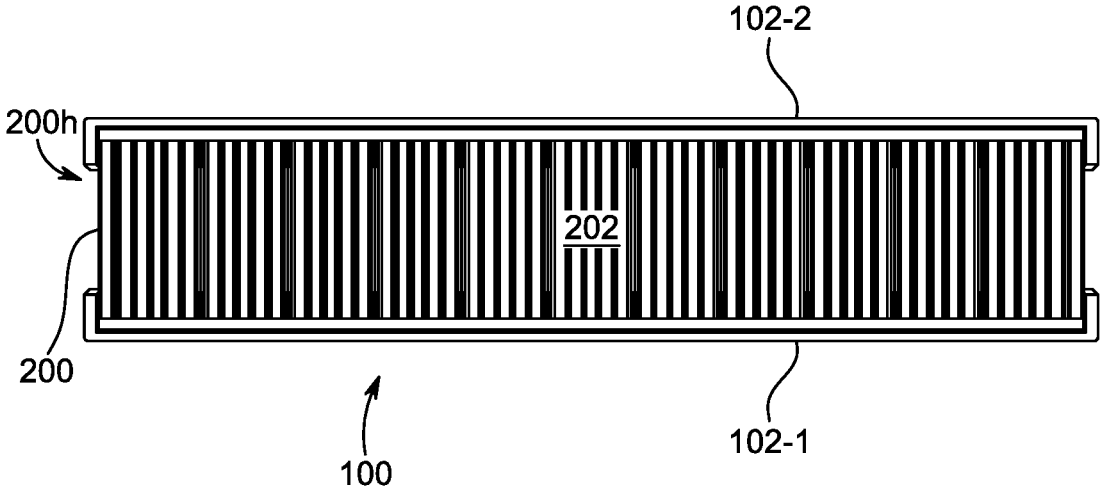
Figure 3:
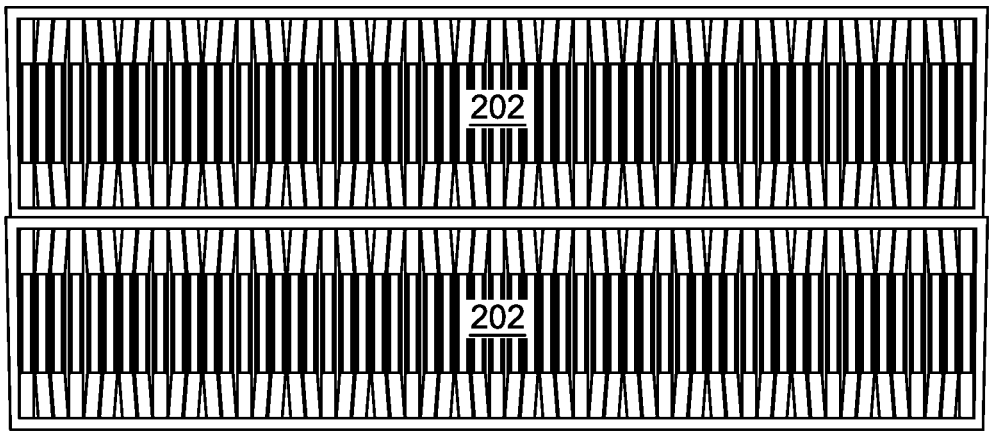
Figure 4:
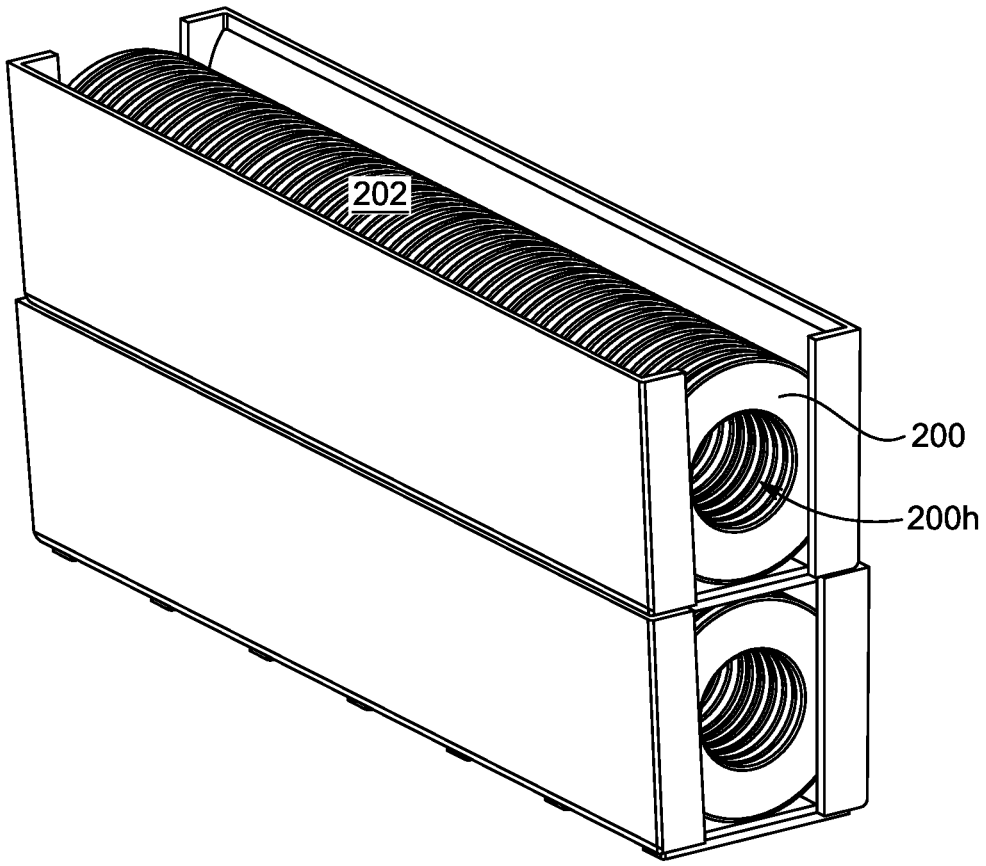
Figure 5:
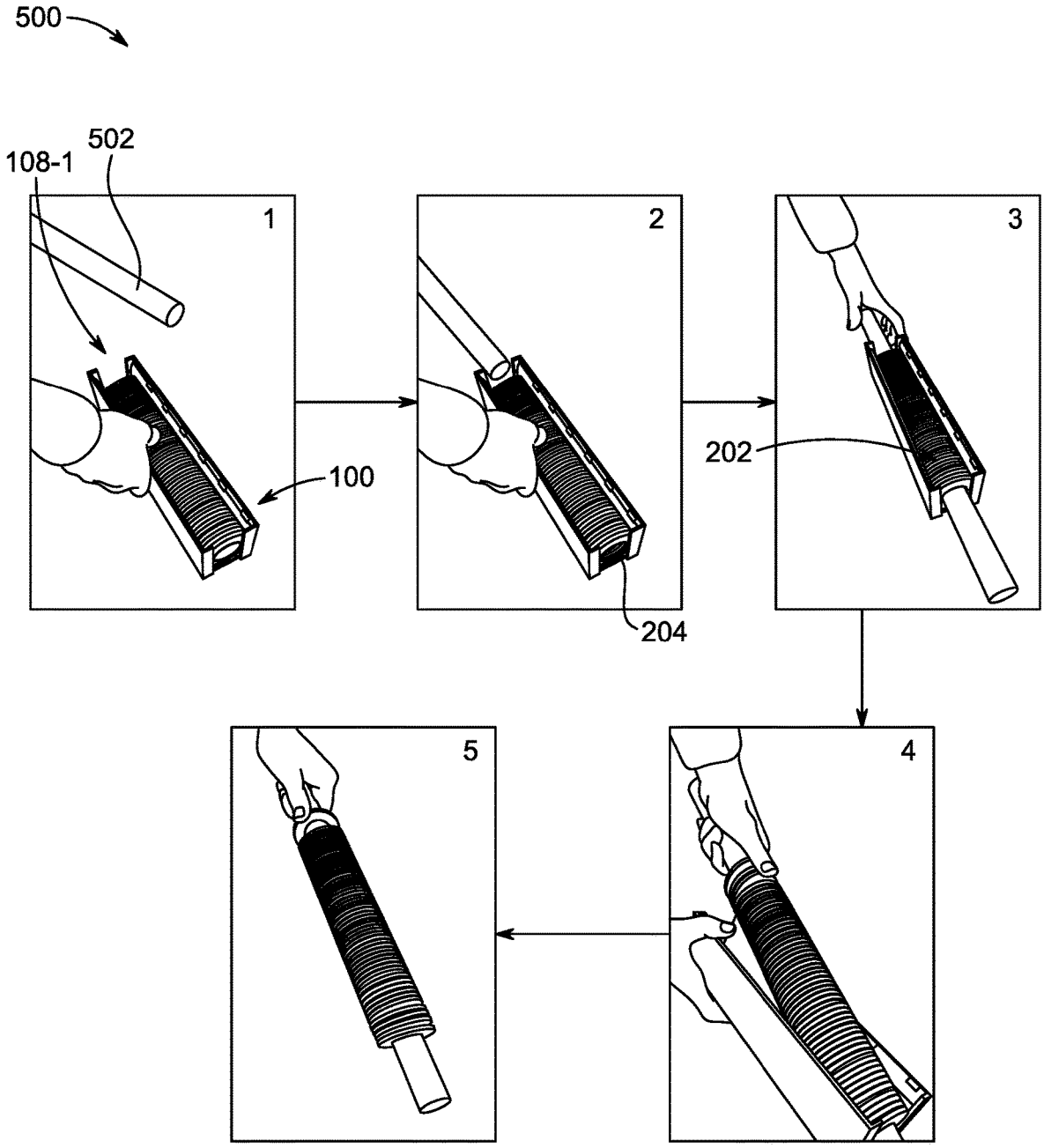

FIG. 1C is a side view of the embodiment shown in FIG. 1B taken along line 1C-1C. This figure shows that the registers 110 have a height h1. The relevance of this distance as a registration structure can be discerned with simultaneously viewed in relation to distance h2 shown in FIG. 1A. distance h2 is the distance from a lateral edge 104-1, 104-2 to an upper edge 111-1, 111-2 of a retainer bead, and it comprises a stack receiver 112-1, 112-2. A first stack receiver 112-1 includes a first upper edge 111-1 of the first retainer bead 106-1, a portion 102'-1 of the first lateral wall between the upper edge 111-1 and the first lateral edge 104-1, a portion 108'-1 of the first partial end wall 108-1, and a portion 108'-2 of the second partial end wall 108-2. Thus, the first stack receiver is adapted to receive a register 110 and to stabilize a stack of carriers 100. The relationship between the height h1 of the register 110 and the height h2 of the first stack receiver 112-1 determines whether the upper edge 111-1 of the first retainer bead is weight bearing, or the first lateral edge 104-1 is weight bearing. More specifically, where h1>h2 the upper edge 111-1 is weight bearing, and where h1<h2 the first lateral edge is weight bearing.

The second stack receiver 112-2 is a mirror image of the first 112-1. It includes the upper edge 111-2 of the second retainer bead 106-2, a portion 102'-2 of the second lateral wall between the upper edge 111-2 and the second lateral edge 104-2, a portion 108'-2 of the first partial end wall 108-1, and a portion 108'-2 of the second partial end wall 108-2. Thus, the second stack receiver is adapted to cooperate with the first stack receiver 112-1 to receive a register 110 and to stabilize a stack of carriers 100. As with the first stack receiver 112-1, the relationship between the height h1 of the register 110 and the height h2 of the second stack receiver 112-2 determines whether the upper edge 111-2 of the second retainer bead is weight bearing, or the second lateral edge 104-2 is weight bearing. More specifically, where h1>h2 the upper edge 111-2 is weight bearing, and where h1<h2 the second lateral edge is weight bearing.

A method of using embodiments of the invention is explained in reference to FIG. 5, where a first step (1) is to position a rod 502 proximal to a first partial end wall 108-1 of a washer carrier 100. The rod 502 is inserted (2) through each central hole 204 of each washer 200 of a column of washers 202. The washer carrier 100 is held stationary while applying upward force to the rod. The rod impinges upon a pair of retainer beads 106-1, 106-2 of the washer carrier. The applied force is sufficient to flex the lateral walls 102-1, 102-2 apart allowing the column of washers to pass therebetween. The column of washers is then withdrawn (4) from the washer carrier (100). The process operates similarly in embodiments having a single retainer bead.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

I claim:

1. A washer carrier (100), comprising:

a semi-closed box having:

an elongate rectangular base wall (101) defining a length (L) and a width (W);

a first lateral wall (102-1) contiguous with and extending away from the base wall (101), the first lateral wall (102-1) having an inward facing surface (102-1*i*);

a first retainer bead (106-1) extending along an entire length of the first lateral wall (102-1), and disposed on the inward facing surface (102-1*i*) of the first lateral wall (102-1) between a first lateral edge (104-1) of the first lateral wall and the base wall (101);

a second lateral wall (102-2) contiguous with and extending away from the base wall (101), the second lateral wall (102-2) having an inward facing surface (102-2*i*); and a first partial end wall (108-1) having a first segment (108-1A) contiguous with the first lateral wall (102-1) and the base wall (101), and a second segment (108-1B) contiguous with the second lateral wall (102-2) and the base wall (101), wherein the first segment (108-1A) and the second segment (108-1B) are separated by a first gap (G-1).

2. The washer carrier of claim 1, wherein the first lateral wall (102-1) and the second lateral wall (102-2) both extend away from the base wall (101) at right angles relative to the base wall (101).

3. The washer carrier of claim 1, wherein the height of the second lateral wall (102-2) is equal to the height of the first lateral wall (102-1).

4. The washer carrier of claim 1, further comprising a second retainer bead (106-2) extending along an entire length of the second lateral wall (102-2), and disposed on the inward facing surface (102-2*i*) of the second lateral wall (102-2) between the second lateral edge (104-2) and the base wall (101).

5. The washer carrier of claim 4, wherein the minimum straight-line distance between the first retainer bead (106-1) and the second retainer bead (106-2) is between 80% and 95% of straight-line distance between the first lateral wall (102-1) and the second lateral wall (102-2).

6. The washer carrier of claim 1, wherein the first lateral wall (102-1) is contiguous with the base wall (101) along the entire length of the base wall (101), and wherein the second lateral (102-2) wall is contiguous with the base wall (101) along the entire length of the base wall (101).

7. The washer carrier of claim 1, further comprising at least one register (110) disposed on an underside of the base wall (101), the at least one register (110) having one or more of:

an outward lateral face (114) parallel to the first lateral wall (102-1), the outward lateral face (114) being the distance t from the first lateral wall (102-1);

an outward lateral face (114) parallel to the second lateral wall (102-2) and the outward lateral face (114) being the distance t from the second lateral wall (102-2);

an outward widthwise face (113) parallel to the first partial end wall (108-1) and the outward widthwise face (113) being the distance t from the first partial end wall (108-1); and an outward widthwise face (113) parallel to a second partial end wall (108-2) and the outward widthwise face (113) being the distance t from the second partial end wall (108-2).

8. The washer carrier of claim 7, wherein the at least one register is dimensioned and oriented such that a lengthwise edge is a distance t from the first partial end wall (108-1), a lengthwise edge is the distance t from the second partial end wall (108-2), a widthwise edge is the distance t from a first lateral wall (102-1), and a widthwise edge is the distance t from a second lateral wall (102-2), wherein the distance t is a thickness of the first lateral wall (102-1), the second lateral wall (102-2), the first partial end wall (108-1), and the second partial end wall (108-2).

9. The washer carrier of claim 7, further comprising a first stack receiver (112-1) defined by a first upper edge (111-1) of the first retainer bead (106-1), a portion (102'-1) of the first lateral wall (102-1) between the first upper edge (111-1) and the first lateral edge (104-1), a portion (108'-1) of the first partial end wall (108-1), and a portion (108'-2) of the second partial end wall (108-2).

10. The washer carrier of claim 9, further comprising a second stack receiver (112-2) defined by a second upper edge (111-2) of the second retainer bead (106-2), a portion (102'-2) of the second lateral wall (102-2) between the second upper edge (111-2) and the second lateral edge (104-2), a portion (108'-1) of the first partial end wall (108-1), and a portion (108'-2) of the second partial end wall (108-2).

11. The washer carrier of claim 1, further comprising a second partial end wall (108-2) having a first segment (108-2A) contiguous with the first lateral wall (102-1) and the base wall (101), and a second segment (108-2B) contiguous with the second lateral wall (102-2) and the base wall (101), wherein the first segment (108-2A) and the second segment (108-2B) are separated by a second gap (G-2).

12. The washer carrier of claim 1, further comprising a second retainer bead (106-2) extending along the entire length (L) of the second lateral wall (102-2), and disposed between a second lateral edge (104-2) of the second lateral wall and the base wall (101).

13. The washer carrier of claim 12, wherein the first retainer bead (106-1) defines a first arcuate surface (106-1A), and the second retainer bead (106-2) defines a second arcuate surface (106-2).

14. The washer carrier of claim 12, wherein the first retainer bead (106-1) defines a first triangular surface (106-1T), and the second retainer bead (106-2) defines a second triangular surface (106-2T).

15. The washer carrier of claim 1, wherein the first lateral wall (102-1) terminates in a first lateral edge (104-1) to define a first height, and herein the second lateral wall (102-2) terminates in a second lateral edge (104-2) to define a second height, wherein the first height is equal to or different from the second height.

16. A washer carrier (100), comprising:

a semi-closed box having:

an elongate rectangular base wall (101) defining a length (L) and a width (W);

a first lateral wall (102-1) contiguous with and extending away from the base wall (101), and terminating in a first lateral edge (104-1) to define a height (H) of the first lateral wall (102-1);

a first retainer bead (106-1) extending along the entire length (L) of the first lateral wall (102-1), and disposed between the first lateral edge (104-1) and the base wall (101);

a second lateral wall (102-2) contiguous with and extending away from the base wall (101), and terminating in a second lateral edge (104-2) to define a height of the second lateral wall (102-2);

a first partial end wall (108-1) having a first segment (108-1A) contiguous with the first lateral wall (102-1) and the base wall (101), and a second segment (108-1B) contiguous with the second lateral wall (102-2) and the base wall (101), wherein the first segment (108-1A) and the second segment (108-1B) are separated by a first gap (G-1); and at least one washer (200) contained within the washer carrier (100) and oriented parallel to the first partial end wall (108-1) and perpendicular to the first lateral wall (102-1), and located between the first lateral wall (102-1), the second lateral wall (102-2), the first partial end wall (108-1) and the first retainer bead (106-1).

17. The washer carrier (100) of claim 16, wherein the at least one washer (200) comprises a column of washers (202).

18. A method of withdrawing a column of washers from a washer carrier, comprising the steps of:

positioning (1) a rod (502) proximal to a first partial end wall (108-1) of a washer carrier (100);

inserting (3) the rod (502) through each central hole (204) of each washer (200) of a column of washers (202);

holding (4) the washer carrier (100) stationary while applying upward force to the rod;

the rod impinging upon a first retainer bead (106-1) of the washer carrier, wherein the applied force is sufficient to flex a first lateral wall (102-1) and a second lateral wall (102-2) apart allowing the column of washers to pass therebetween; and withdrawing (5) the column of washers from the washer carrier (100).

* * * * *